United States Patent [19]

Kumar et al.

[11] 4,382,696

[45] May 10, 1983

[54] ELECTRO-OPTICAL ANALOG TIME DISPLAY DEVICE

[75] Inventors: Niraj Kumar, Indialantic, Fla.; John Varney, Hayes, England

[73] Assignee: Ebauches Electroniques, S.A., Switzerland

[21] Appl. No.: 235,540

[22] Filed: Feb. 18, 1981

[30] Foreign Application Priority Data

Feb. 18, 1980 [CH] Switzerland ..... 1290/80

[51] Int. Cl.[3] ..... G04C 17/02

[52] U.S. Cl. ..... 368/240

[58] Field of Search ..... 368/82-84, 368/239-242; 340/765, 756

[56] References Cited

U.S. PATENT DOCUMENTS

| | | | |
|---|---|---|---|
| 4,209,974 | 7/1980 | Noble | 368/84 |
| 4,254,488 | 3/1981 | Ojima et al. | 368/82 |
| 4,255,806 | 3/1981 | Fahrenschon et al. | 368/240 |

*Primary Examiner*—Vit W. Miska

*Attorney, Agent, or Firm*—Allegretti, Newitt, Witcoff & McAndrews, Ltd.

[57] ABSTRACT

The device displays an hour hand and a minute hand on a twelve hour dial and comprises a layer of electro-optical material having on one face an inner ring of 10 sectorial plate electrodes $B_1$ etc, each subtending an angle of 36° and a corresponding outer ring of 10 plate electrodes $B_{11}$ etc. On the other face there are sixty radial segments electrodes arranged in ten groups of six segments. Each group is opposed to a respective one of the ten plates. The segments are connected in six meandering circuits $M_1$ to $M_6$ so that, in proceeding one way round the dial, the segments of the said groups pertaining to the circuits $M_1$ to $M_6$ and then to the circuits $M_6$ to $M_1$ and so on in alternation round the dial. As can be seen from the steady lines demarcating the plate electrodes, these electrodes are assymetrical relative to the 12 o'clock axis of the dial so that there is a boundary between two adjacent plates in each ring angularly offset from that axis by a whole number of the segments, namely one segment as illustrated.

10 Claims, 7 Drawing Figures

157
158
B1
B2
B3
B4
B5
B6
B7
B8
B9
B10
B11
B12
B13
B14
B15
B16
B17
B18
B19
B20
MB
152
129
TH1
TH2
TM
MULTIPLEX.
HB
130
DECODER
HB
152
COMPARATOR
MB
H1M
153
COMPARATOR
MM
154
COMPARATOR
H2M
A
B
C
φ, θ
132
CM5
CM4
CM3
CM2
CM1
M1
151
M2
M3
M4
M5
M6
MM
TM
126
TH1
MULTIPLEX.
TH2
H1M
H2M
DECODER
127

ELECTRO-OPTICAL ANALOG TIME DISPLAY DEVICE

BACKGROUND OF THE INVENTION

The invention relates to an electro-optical time display device, of the type in which the time information is represented in analog form by the simulation of hands rotating over an hour dial.

A display device of this type is described in published British patent application No. 2,014,337. Simulation of the hands is effected by electro-optical means which comprise, over the entire surface of the dial, an electro-optical material, comprising for example liquid crystals, enclosed between electrodes which are distributed in two layers and which are individually placed under the control of time counting means. At positions where the electrodes of the two layers are simultaneously excited at opposite potentials with respect to a neutral potential, so as to subject the electro-optical material to a sufficient electrical field, that material appears in a contrasting mode against the remaining background of the dial. In order to simulate movement of the hands, the arrangement is thus controlled to provide sequential excitation of electrodes in the form of sectors or dial segments which are distributed all around the dial, at the speed of forward movement of the hands as determined by the counting means.

In order to provide a representation which is comparable to that of the hands of conventional clocks and watches, in particular the minute and hour hands, it has been necessary to form the electrodes of the layer on one side of the electro-optical material in the form of radial segments which are distributed all around the dial, and to form the electrodes of the other layer, on the other side of the electro-optical material, in the form of sectorial plates which are distributed in two concentric rings. Each ring thus includes a plurality of plates which are distributed all around the dial, but each plate covers a sector of an angular extent which is a multiple of that of each segment. The minute hand is simulated by a radial segment which is made visible over its entire length by simultaneous excitation of that segment and both of the plates which are opposed to it, namely one plate of the internal ring and one plate of the external ring. The hour hand is simulated by one segment or by two adjacent segments which are excited simultaneously, but only over a part of their length, with simultaneous excitation of the opposed plate which belongs to the internal ring, and not that in the external ring.

It will be appreciated that the sequential control of the electrical supply connections can become highly complex, depending on the number of separate electrodes, although that number must be sufficient to permit reasonable representation of the position of the hands and the movement thereof. There are preferably 60 segments, so that controlling the minute hand involves causing the simultation and therefore excitation to pass from one segment to the following segment every minute. In other words, the displayed minute hand changes position every minute. In order to ensure that the number of electrical connections is acceptable in the construction of clocks and even watches, the above-identified British patent application provides for a supply in series by the same electrical circuit for segments associated with different opposed plates, this being effected in correlation with a multiplexing control system.

There are ten groups of radial segments, each group comprising six successive segments opposed to the same pair of sectorial plates. Furthermore, the dial comprises ten of these pairs in the same manner as it comprises ten groups of segments. The segments are electrically connected in series in tens, one of each group, to form meandering circuits, that is to say, the circuits meander between segment connections alternately at the radially inner and radially outer ends of the segments. At the boundary between two sectors, the two adjacent segments which are respectively associated with different plates belong to the same meandering circuit (and may therefore be joined as a double width segment).

The above-identified British application also describes, with all the details required, the manner in which such a time display dial may be controlled by multiplexing logic circuits on the basis of data relating to the state of time counters, in binary form. The display of a suitable segment in the correct sector, on the internal ring alone if the display involves the hour hand, or on both the internal ring and the external ring if the display involves the minute hand, involves exciting the proper meandering circuit and simultaneously exciting the proper sector-shaped plate or plates on the other face of the dial. The published British application discloses how to obtain mean electrical fields between those electrodes which determine whether there is or is not a display, it being deemed sufficient to have four square wave forms for the plates, which are phase-shifted through 90° relative to each other, and, for the meandering circuits, four other wave forms which are derived from the same wave form having three plateaux, also by phase shifting through 90°. The combinations of these wave forms having two and three plateaux provide all the control actions required for simulation of the different positions of the hands of the dial.

However, the watches which it has been possible to contruct in accordance with the foregoing are still seriously deficient in regard to the quality of simulation. In particular, the position of the hour hand, when the time is right on an hour, is spaced at such a distance from its normal position, relative to the corresponding figure, that reading of the time becomes uncertain. In addition, a representation which is similar to that given by conventional dials with hands requires that the hour hand must be formed by two segments which are disposed side-by-side in the internal ring in order clearly to distinguish it from the minute hand and, in this case, it has not been possible hitherto to design control circuits which retain all the desired degree of simplicity.

BRIEF SUMMARY OF THE INVENTION

The present invention seeks to overcome these disadvantages, and in particular to improve the quality of simulation with respect to conventional dials with hands, at an acceptable manufacturing price, this being effected by virtue of the design of the electro-optical dial and also by the design of the electronic circuits for controlling excitation of the electrodes.

According to the present invention, there is provided an electro-optical analog time display device of the type comprising an hour dial giving an electro-optical display simulating hands by simultaneous excitation of electrodes on the two faces of a layer of an electro-optical material, on which dial the hours are distributed in accordance with a circular symmetry of order 12 from an axis marking 12 o'clock, which the electrodes comprise, on one of the faces of the dial, sectorial plates which are distributed over ten angular sectors, in accordance with a circular symmetry of order 10, and, on the opposite face of the dial, radial segments which are distributed in ten groups, one group in each of the angular sectors and which are electrically connected in series to form meandering circuits in accordance with a circular symmetry of order 5, and wherein the boundary between the first and the last of the sectors is displaced asymmetrically, by a whole number of segments with respect to the said axis of the dial marking 12 o'clock.

In accordance with a preferred embodiment of the invention, for a dial on which there are sixty segments which are electrically connected in sets of ten, one from each group, to form six meandering circuits, the above-mentioned displacement is by one or two segments and preferably only one segment.

The dial is used in combination with electronic circuits for controlling the electrodes in dependence on the state of time counters. For a dial on which there are two rings of the plates, namely concentric, internal and external rings, in the ten angular sectors, the electronic circuits are advantageously so connected as to simulate a minute hand by a segment displayed on the plates of the two rings of the corresponding angular sector, which segment by segment perform one turn around the dial per hour, and an hour hand, by means of two contiguous segments which are displayed on the internal ring only, passing around the dial in a period of 12 hours, and so as to control the display of the minute hand which is synchronized to a segment adjoining the axis marking 12 o'clock, with the display of the hour hand centered on that axis.

These arrangements make it possible to provide simulation in which the hour hand is disposed precisely in position, when the time is exactly on the hour, with the minute hand indicating 00 minutes, aligned with the axis of the dial which marks 12 o'clock. This is verified at least at the four quarters of the dial, namely at 12 o'clock, 3 o'clock, 6 o'clock and 9 o'clock.

It is possible to tolerate a certain error which is limited to the angular interval of a single segment, when the time is precisely on intermediate hours, for example 1 o'clock and 7 o'clock when the displacement of the sectors is by one segment behind the axis of the dial, or 5 o'clock and 11 o'clock when the displacement of the sectors is by one segment ahead of the axis of the dial. The advantage is that, while simulating the hour hand by means of two segments which are disposed side-by-side, it is possible to retain a high degree of simplicity in respect of the electronic multiplexing control circuits, by avoiding display at the same time of two segments of the same meandering circuit for the hour hand, with, for the minute hand, another segment which is disposed in one of the same angular sectors as the foregoing segments. As the hour hand comprises two contiguous segments, this condition could be fulfilled at the moment that the hand straddles the boundary between two sectors, if the minute hand was at the same time on one of those sectors. In fact, it is only at the boundary between two sectors that it is possible to find the two adjacent segments which are respectively associated with different plates, while belonging to the same meandering circuit. In practicing the invention, it is then advantageous to cause the hour hand to jump the above-mentioned boundaries, whereas the remainder of the time it advances segment by segment, by one segment every twelve minutes when there are a total of sixty segments for one revolution of a twelve hour dial.

In other words, the electronic circuits are advantageously connected in such a way as to cause the two segments of the hour hand to jump simultaneously from one sector to the other, at each boundary between two sectors, while over the rest of the dial, the circuits cause regular advance of the hand segment by segment, while imposing a double-length stay on one side or the other of each boundary between two sectors. For a rate of advance from one segment to another with twelve minutes per segment, crossing of each boundary is effected both segments at once with an advance or a delay of twelve minutes.

Moreover, the quality of simulation is further enhanced if, for a dial comprising sixty segments, the advance movement of the hour hand is controlled at a rate of twelve minutes per segment, with a displacement in time of six minutes with respect to the movement of the minute hand to 00 minute on a segment adjoining the axis marking 12 o'clock. When the time is precisely on an hour, except possibly at two opposite positions such as 1 o'clock and 7 o'clock, but in any even at 12.00, 3.00, 6.00 and 9.00, the hour hand is then precisely in position for a period of six minutes before the exact hour and six minutes afterwards.

The other novel features set out hereinafter provide simplified electronic circuits, in conjunction with the dial as already defined above. The electronic circuits preferably comprise means for determining the positions of the minute hand and of each of the arms of the hour hand, in dependence on the state of the time counters, and for selecting the corresponding meandering circuits and the plates of the corresponding angular sectors (internal annular sectors and external annular sectors), comparison means for respectively defining, by three comparison signals: (A) if the sector of the minute hand and that of the hour hand are identical, (B) if the meandering circuit of the first arm of the hour hand and that of the minute hand are identical, and (C) if the meandering circuit of the second arm of the hour hand and that of the minute hand are identical, and means which are controlled by the comparison signals for selecting corresponding waveforms to be applied to the meandering circuits, to the internal sectors, to the external sectors, and for applying them to the selected meandering circuits and plates. The waveforms may be selected in particular from four waveforms with three plateaux, which are phase-shifted through 90° relative to each other for the meandering circuits, two square waveforms and a reference signal for the internal sectors, and a square waveform and a reference signal for the external sectors.

Selection of the meandering circuits may be effected under the control of signals which in binary form carry the position information supplied in each counting cycle of the circuits, with inversion of the signals in the course of one cycle in two. This makes it possible to simplify the circuits for control and selection among the succession of meandering circuits, as there is no requirement to act on the direction of counting in order to follow the order of segments as they appear on the dial.

BRIEF DESCRIPTION OF THE DRAWINGS

The invention will be described in more detail, by way of example, with reference to the preferred embodiment illustrated in the accompanying drawings, in which.

DETAILED DESCRIPTION OF THE PREFERRED EMBODIMENT

Figure 1:
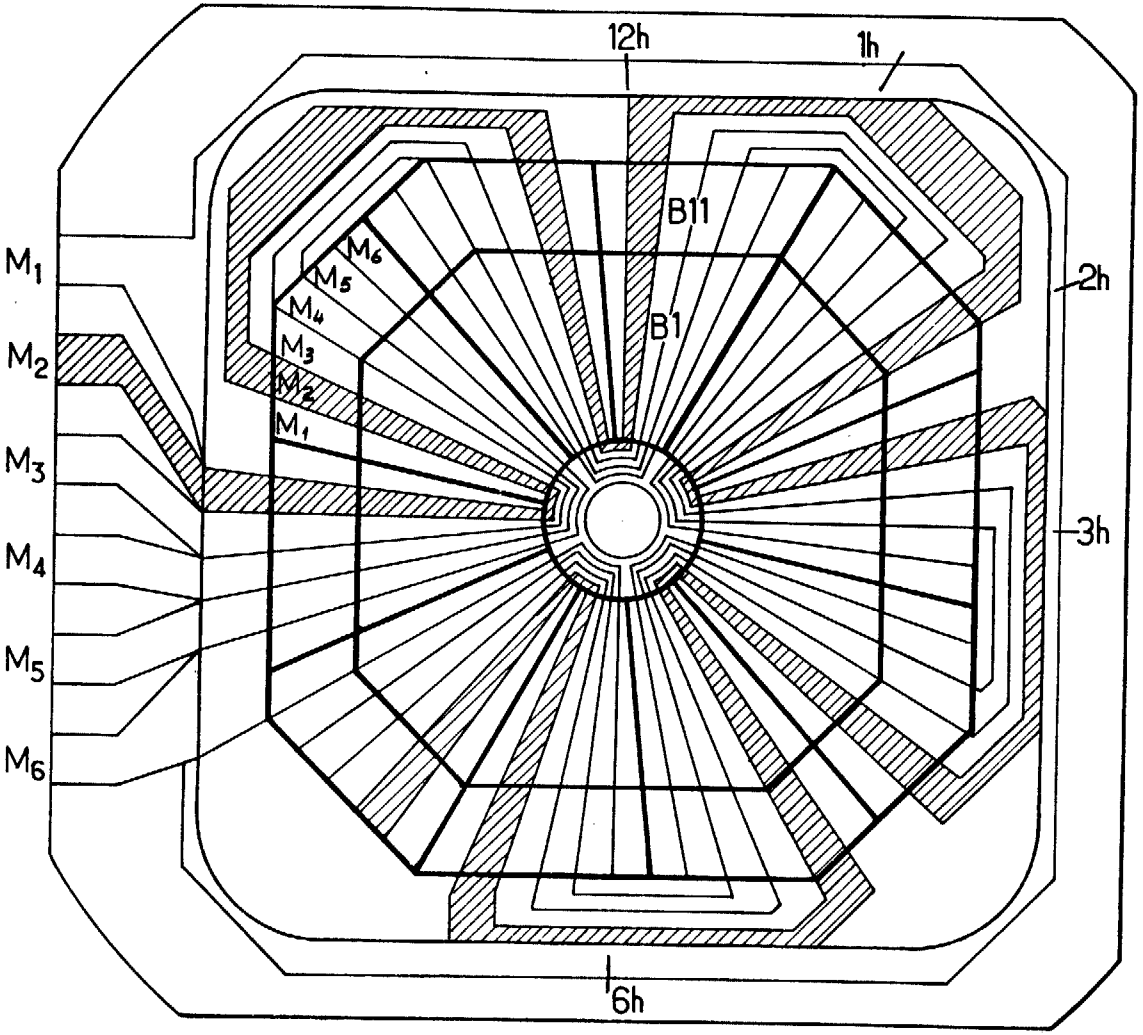
FIG. 1 is a diagrammatic view of the form and arrangement of the electrodes on the top and on the bottom of the dial.

Referring to FIG. 1, there is shown therein a diagrammatic view of the hour dial providing an electro-optical analog representation, which is used for displaying time, in hours and minutes. In the particular illustrative embodiment considered herein, the electro-optical material is based on liquid crystals and the manner of display is in principle similar to that described in British patent application No. 2,014,337 in that the material is enclosed between two layers of electrodes, in the form of radial segments on one face of the dial, and in the form of sectorial plates on the opposite face, and that, in order to cause a segment to appear in contrast with the background of the rest of the dial, the electrical field required is produced by simultaneous excitation of two layers of electrodes at that location.

For purposes of illustrating the principles of the invention, FIG. 1 shows the constitution of two layers of electrodes on the dial, as if they were both visible on the top of the dial, whereas in actual practice this is obviously not the case. However, the view shown in FIG. 1 has the attraction of showing the relative arrangement of the electrodes, as between one face and the other face of the dial. On the top face, the conducting layer is divided into sixty radial segments which are regularly distributed all around the dial. On the underside, the other conducting layer is divided into twenty plates which are distributed in two concentric rings over ten equal angular sectors. This arrangement thus provides a circular symmetry of order 10, whereas obviously the figures or other markings indicating the hours, 12 o'clock, 1 o'clock, 2 o'clock, etc, on the dial, are distributed in accordance with a circular symmetry of order 12. Each of the electrode plates is in the form of an annular sector and there are ten pairs of such sectors, each of which, in the same angular sector, comprises an internal annular sector, e.g. as shown at $B_1$ and a corresponding external annular sector as shown at $B_{11}$. In the embodiment shown in FIG. 1, the outlines of the annular sectors are defined by straight lines so as to simulate hands adapted to a square dial, as shown.

Figure 2:
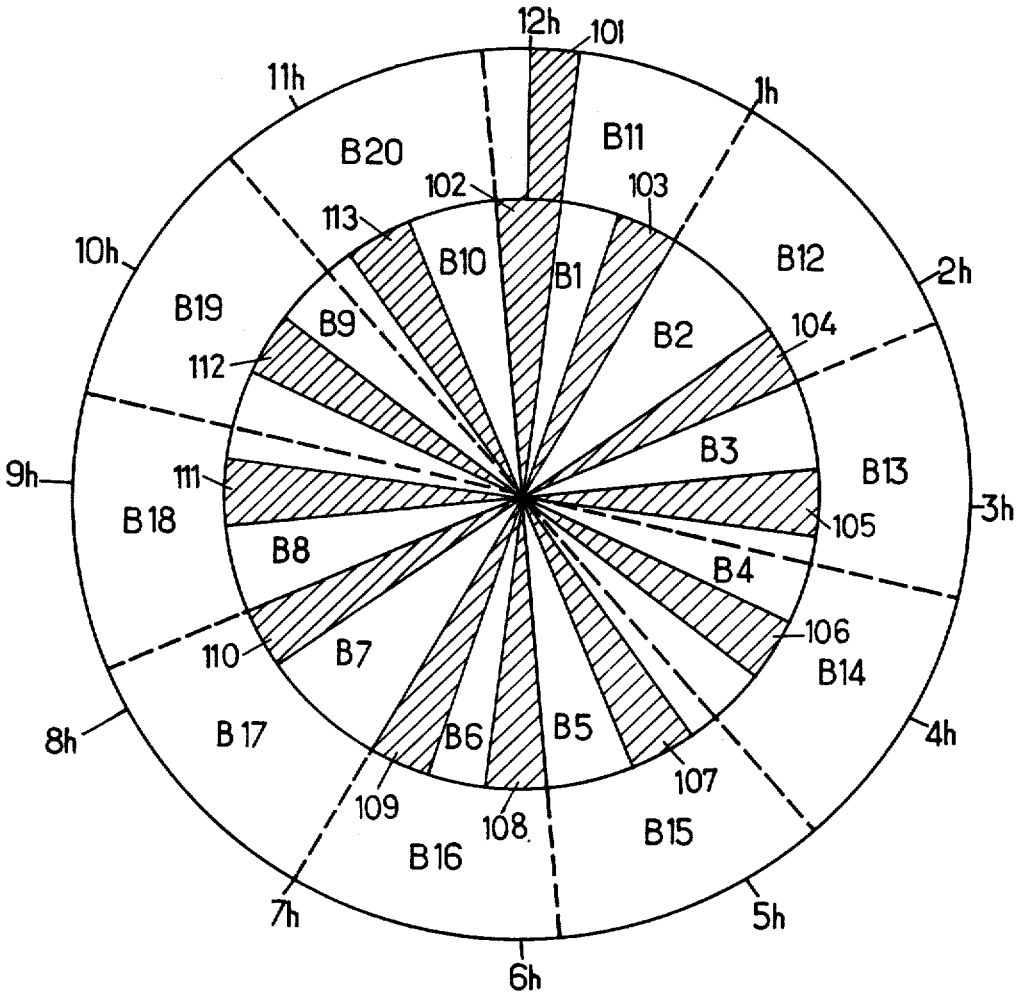
FIG. 2 shows different positions of the hands simulated on the dial.

The numbering of the angular sectors has been completed in FIG. 2, going from $B_1$ to $B_{10}$ for the internal ring and from $B_{11}$ to $B_{20}$ for the external ring. These further figures have not been included in FIG. 1 in order not to clutter the drawing. For the same reason, the drawing does not show the electrical connections which, on the under face of the dial, make it possible individually to excite each of the plates in the form of annular sectors. On the other hand, the drawing shows the electrical connections which combine together in groups the segments on the top face of the dial. The sixty successive segments are distributed in ten groups, each of six segments, for which there are only six supply circuits referenced as $M_1$ to $M_6$. Each circuit, for example, the circuit $M_2$ which is shown by hatching in FIG. 1, describes a meandering path all around the dial, electrically connecting in series ten separate segments which respectively belong to the ten groups. The conducting layers which connect one segment to the following segment of the series are disposed alternately at the center and on the outside of the dial, but always outside the surface which is occupied, on the other face of the dial, by the annular sectors. They therefore are never made visible when the hands are simulated. If the segments are considered in the order in which they are encountered in passing continually around the dial, the circuits to which they belong occur in succession from $M_1$ to $M_6$, then from $M_6$ to $M_1$, then again from $M_1$ to $M_6$, and so on. Therefore, two successive segments which are electrically connected together are encountered every five segments. As FIG. 1 also shows, the annular sectors $B_1$–$B_{10}$, $B_{11}$–$B_{20}$ are disposed with respect to the radial segments so that each covers the angular space occupied by six segments. Moreover, the connections between the segments and their supply circuits are made in such a way that each group of six segments respectively belonging to the six supply circuits is positioned precisely in one of the ten angular sectors which are defined by the plates in the form of annular sectors. This means that, where two adjacent segments are not distinguished from each other on the top face of the dial because they belong to the same supply circuit $M_1$ or $M_6$, separation between those two segments is effected, on the other face of the dial, by the radial boundary between two pairs of annular sectors. Finally, the position of such boundaries between the successive sectors is not arbitrary on the dial. Close to the axis of origin of the dial, being that radius which marks 12 o'clock, the radial boundary between the two sectors is displaced with respect to that axis by an angular distance which corresponds precisely to the angular distance of a segment, and towards the left, that is to say, in the direction of trailing behind the time display.

The main purpose of FIG. 2 is to show the positions of the hands which are simulated on the dial in FIG. 1, at different moments in the movement thereof. Indeed, the different positions of the hands as time passes are not determined only by the form and the arrangement of the electrodes on the dial in FIG. 1. They are just as much determined by the electronic circuits which control excitation of the electrodes, in dependence on the time counting means. However, it will be easier to understand the description of the electronic circuits when the principle of simulation has been discussed. FIG. 2 also shows how the minute hand and the hour hand are simulated separately. Thus, the minute hand is simulated by displaying a long segment, bearing reference 101 in FIG. 2, which is produced by excitation of the electrode defining that segment, or more precisely the meandering circuit to which it belongs, and simultaneous excitation of the two annular sector-shaped circuits which are facing it on the other side of the dial, in the same angular sector. Thus, the segment 101 appears in a contrasting mode against the background of the remainder of the dial, both in the internal ring (sector $B_1$) and the external ring (sector $B_{11}$). Conversely, the segments remain non-displayed in the external ring when the hour hand is to be simulated, as indicated at 103 in FIG. 2. In contrast, the minute hand is simulated as wider than the hour hand. It covers two adjacent segments which will also be denoted hereinafter as the two arms of the hour hand. Simulation of the hour hand therefore requires simultaneous excitation of two segments which are disposed side by side and the internal annular sector which is disposed facing those two segments. Rotation of the simulated hour hand is also so controlled that the two side-by-side segments which simulate that hand are always disposed in the same sector. In other words, display of the hour hand is always controlled by excitation of a single sector of the internal ring and simultaneous excitation of two meandering circuits which respectively supply two side-by-side segments, and any situation is avoided in which those two segments would be disposed on respective sides of the boundary between two adjacent sectors, in which case the display would conversely have to involve two different sectors and a single common meandering supply circuit. It will be recalled in fact that, at the boundary between two sectors, the adjacent segments belong to the same meandering supply circuit $M_1$ or $M_6$.

It also will be noted from the description of FIG. 1 that, by virtue of its construction, the electro-optical analog time display device of the type in question comprises, for a twelve hour dial, only ten sectors of electrodes with their associated segments. This means that the hour hand must move less than one sector to the next. At that moment, the hour hand is caused to move two segments in one movement, the hand thus jumping the boundary between the two consecutive sectors, whereas the rest of the time, the hand advances more progressively, a single segment at a time. As the whole of the dial comprises sixty segments, the segment-by-segment advance movement is effected each minute for the minute hand, and normally every twelve minutes for the hour hand (sixty segments in twelve times sixty minutes). The advance movement of the hour hand is effectively produced every twelve minutes the entire time that it is in fact moving forward segment-by-segment, but when it reaches the boundary between two sectors, it is held back for twelve additional minutes in the sector that it is about to leave, before passing across the two segments together in the following sector.

When it is precisely midday or 00 o'clock, the minute hand being displayed at 101 in FIG. 2 by one of the segments adjoining the axis of the dial marking 12 o'clock, the hour hand is simulated at 102 in FIG. 2 by the two short segments of the sector $B_1$, which are disposed on respective sides of the above-mentioned axis. This is possible because the boundary of original of the sectors is displaced with respect to the axis of the watch. The hour hand is maintained in that position for twelve minutes, and any change in its position precisely on the hour is avoided. For that purpose, the forward movement of the hour hand segment-by-segment is displaced by six minutes with respect to the movement of the minute hand through the axis of the watch. Thus, for example, with its two arms, the hour hand takes up the position illustrated at 102 in FIG. 2, at 11:54, six minutes before precisely on the hour, and it moves out of that position six minutes after the precise hour, at 12:06.

Taking into account the positioning adopted in respect of the boundary between the two sectors relative to the markings which mark the hours on the dial, the hour hand is in the different positions illustrated in FIG. 2, precisely on the hour: at position 103 at 1:00, position 104 at 2:00, at position 105 at 3:00 and so on, up to position 113. It will be noted that the hand is then almost precisely facing the marking which marks the corresponding hour, and that this is the case in particular at position 102 at 12 o'clock, 105 at 3 o'clock, 108 at 6 o'clock and 111 at 9 o'clock. It is only in two cases, namely at position 103 at 1 o'clock and position 109 at 7 o'clock, that the hour hand cannot be precisely in place on the hour, as it is then approaching the boundary between two sectors. However, the positional error remains small, equivalent to the angular width of a segment, and it exists only until six minutes after the minute hand has passed over the axis of the watch, that is to say, up to 1:06 or 7:06.

Figure 3:
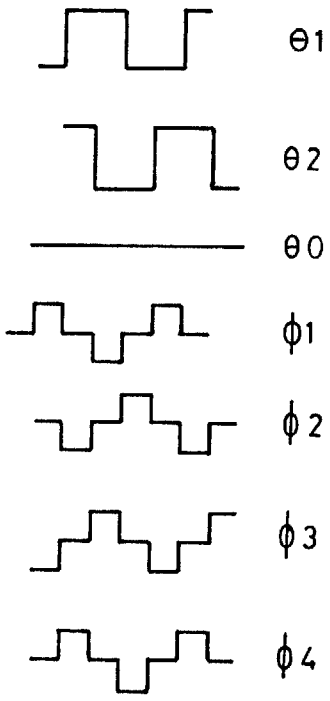
FIG. 3 shows production of the waveforms used for excitation of the electrodes.

This description of the invention will now define the signals which are applied to the electrodes in order to control excitation of the suitable segments, and the manner of selection thereof. In this manner of selection of the electrodes, the device according to this invention differs from the prior device described in British patent application No. 2,014,337, although waveforms formed in the same manner are used for the excitation signals. One or other of two square waveforms which are phase shifted relative to each other through 90°, namely θ1 and θ2, can be applied to each of the annular sectors $B_1$ to $B_{20}$. In either event, any one of four waveforms Ø1, Ø2, Ø3 and Ø4 can be applied to each of the meandering circuits, all four waveforms being formed by waveforms comprising three plateaux and each being derived from the previous one by a 90° phase shift. These waveforms, which are shown in FIG. 3, are of the same type as those described in the above-mentioned British patent. Combinations thereof make it possible to display or not display the relevant parts of the dial, depending on the mean value of the alternating electrical field generated between the facing electrodes to which they are applied. The essential point in regard to operation of the device embodying the invention is that the waveform θ1 which is applied to an annular sector results in a display for the segments to which the waveforms Ø1 or Ø2 are applied, and extinction of the display for the segments which received the waveform Ø3 or Ø4, and in contrast, when the waveform θ2 is applied to an annular sector, a display is produced in respect of the facing segments which receive the waveform Ø2 or Ø3, and extinction in respect of those which receive the waveform Ø1 or Ø4. Moreover, a flat signal θ0 at the reference voltage is applied to all the annular sectors which are not selected to receive one of the waveforms θ1 and θ2, and the waveform Ø4 constitutes, for the meandering supply circuits, a reference signal which always results in extinction of all the segments of the circuit to which it is applied.

For the annular sectors and the meandering circuits in which the hands to be displayed are disposed, selection of the waveforms necessary to result in the required display is affected in dependence on three comparison criteria. These three criteria are as follows:

A: whether the internal annular sector in which the two arms of the hour hand are disposed is or is not the same as that in which the minute hand is disposed;

B: whether the minute hand and the first arm of the hour hand are or are not on the same meandering circuit;

C: whether the minute hand and the second arm of the hour hand are or are not on the same meandering circuit.

The different possibilities which then exist are set out in the following table in which the meander circuits pertaining to the first and second hour hand arms and the minute hand are denoted H1, H2 and M respectively, while the sectors pertaining to the hour and minute hands are denoted HB and MB respectively.

| | Meander circuits | | | Annular sectors | | |
|---|---|---|---|---|---|---|
| | | | | | Minutes | |
| | Hours H1 | H2 | Minutes M | Hours HB (int) | MB int | MB ext |
| A no B no C no | Ø3 | Ø3 | Ø1 | θ2 | θ1 | θ1 |
| A yes B no C no | Ø3 | Ø3 | Ø2 | θ2 | θ2 | θ1 |
| A no B yes C no | Ø2 | Ø3 | Ø2 | θ2 | θ1 | θ1 |
| A no B no C yes | Ø3 | Ø2 | Ø2 | θ2 | θ1 | θ1 |
| A yes B yes C no | Ø2 | Ø3 | Ø2 | θ2 | θ2 | θ1 |
| A yes B no C yes | Ø3 | Ø2 | Ø2 | θ2 | θ2 | θ1 |

In every case, all meander circuits other than H1, H2 and M are connected to Ø4 and all sectors other than HB, MB int and MB ext are connected to θ0. The table has no entries for A no B yes C yes and A yes B yes C yes since it is not possible to have both B yes and C yes.

The table takes account of the fact that the two arms of the hour hand are distinguished only in respect of the segments, that is to say, the meandering circuits, and not in respect of the annular sectors, and also takes account of the fact that, in respect of the annular sectors, the hour hand concerns only the internal annular sector whereas the minute hand involves both the internal sector (int) and the external sector (ext). The choice has been made to allocate, as priority, signal θ1 to the external annular sector of the minute hand and the signal θ2 to the hour hand, but other combinations of these signals are equally possible, in the same manner, in regard to the meandering circuits, as other combinations of the signals than those which are indicated could be used while giving the same results.

In order now to describe the circuits for controlling the display in dependence on time, it will first be recalled that this control involves:

determining the positions on the dial;

of the minute hand, which changes each minute of the hour hand, first arm and the hour hand, second arm, which change every twelve minutes;

these hands can be represented by sixty segments which may be short or long, on the dial on which the segments are distributed:

over one face, as six meander-configuration circuits on the other face, as ten internal ring sectors (internal sectors)

and ten external ring sectors (external sectors);

selecting the suitable waveforms to be applied in each of these positions:

to the meander-configuration circuits, from four possibilities of waveforms Ø1, Ø2, Ø3 and Ø4, to the internal sectors, from three possibilities θ0, θ1 and θ2, and to the external sectors, from two possibilities θ0, θ1.

Figure 4:
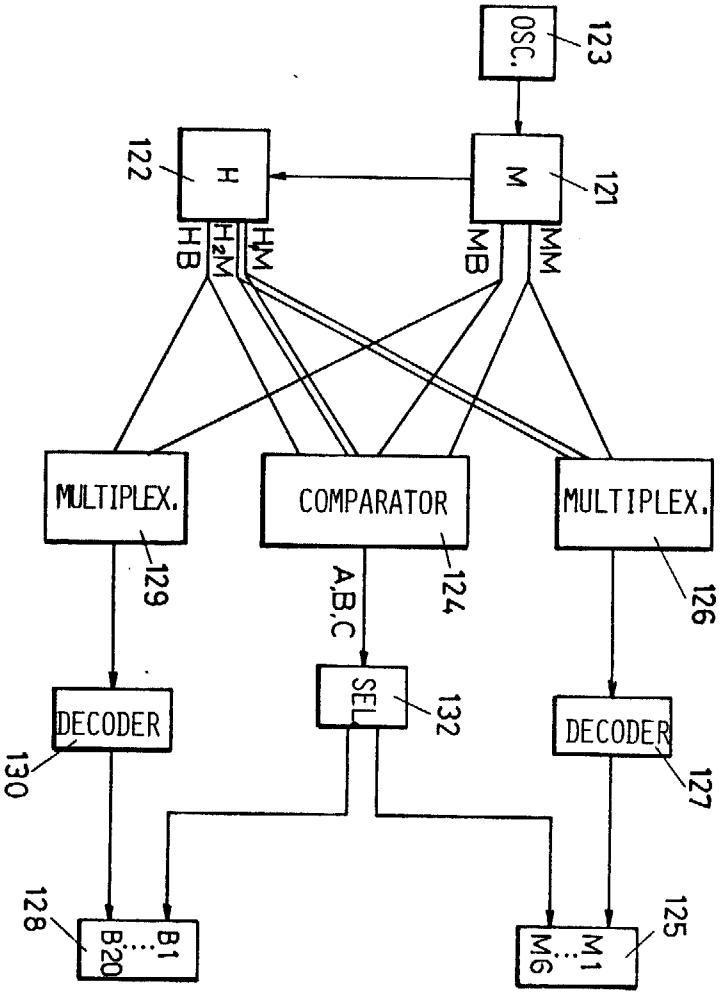
FIG. 4 is a block diagram of the whole of the electronic control circuits.

As shown in FIG. 4, the electronic display control circuits essentially comprise a counter 121 for advancing the minute hand and a counter 122 for advancing the hour hand at 122, which counters, in response to the pulses produced at a given frequency by an oscillator 123, supply signals which represent in binary coded form the positions that must be assumed at each moment respectively by the minute hand and the hour hand, in dependence on the states of the counters. From the minute hand advance counter 121, the data MM which determine the meandering circuit corresponding to the position of the minute hand are transmitted on the one hand to a comparator 124 and on the other hand to an assembly 125 for controlling excitation of the meander circuits $M_1$ to $M_6$, by way of a multiplexer 126 followed by a decoder 127. The data MB which issue from the same counter 121 but which relate to the annular sectors are, in turn, transmitted on the one hand to the comparator 124 and on the other hand to an assembly 128 for controlling excitation of the annular sectors B1 to B20, by way of a multipler 129 followed by a decoder 130. The hour hand advance counter 122 supplies on the one hand data HB determining the sector in which the hour hand is disposed, which data are transmitted, like the data relating to the minute hand sector, on the one hand to the comparator 124 and on the other hand to the multiplexer 129 and from there by way of the decoder 130 to the assembly 128 providing control of excitation of the different annular sectors. It also supplies two groups of data $H_1M$ and $H_2M$ which respectively concern the two arms of the hour hand, and which define the corresponding meander circuits, which data are transmitted to the comparator 124 and, by way of the multiplexer 126 and the decoder 127, to the assembly 125 for controlling excitation of the meander circuits.

The comparator 124 makes comparisons in accordance with the criteria A, B and C and it supplies corresponding data from which selection signals are established in a circuit 132. The selection signals are then transmitted some to the assembly 125 and others to the assembly 128 where they determine selection of the appropriate waveforms respectively for the meander circuits and for the annular sectors. THe waveforms produced in dependence on these selection signals are applied to the meander circuits or to the annular sectors which are selected moreover, in position on the dial, in accordance with the data transmitted by way of the multiplexers and decoders.

Figure 5:
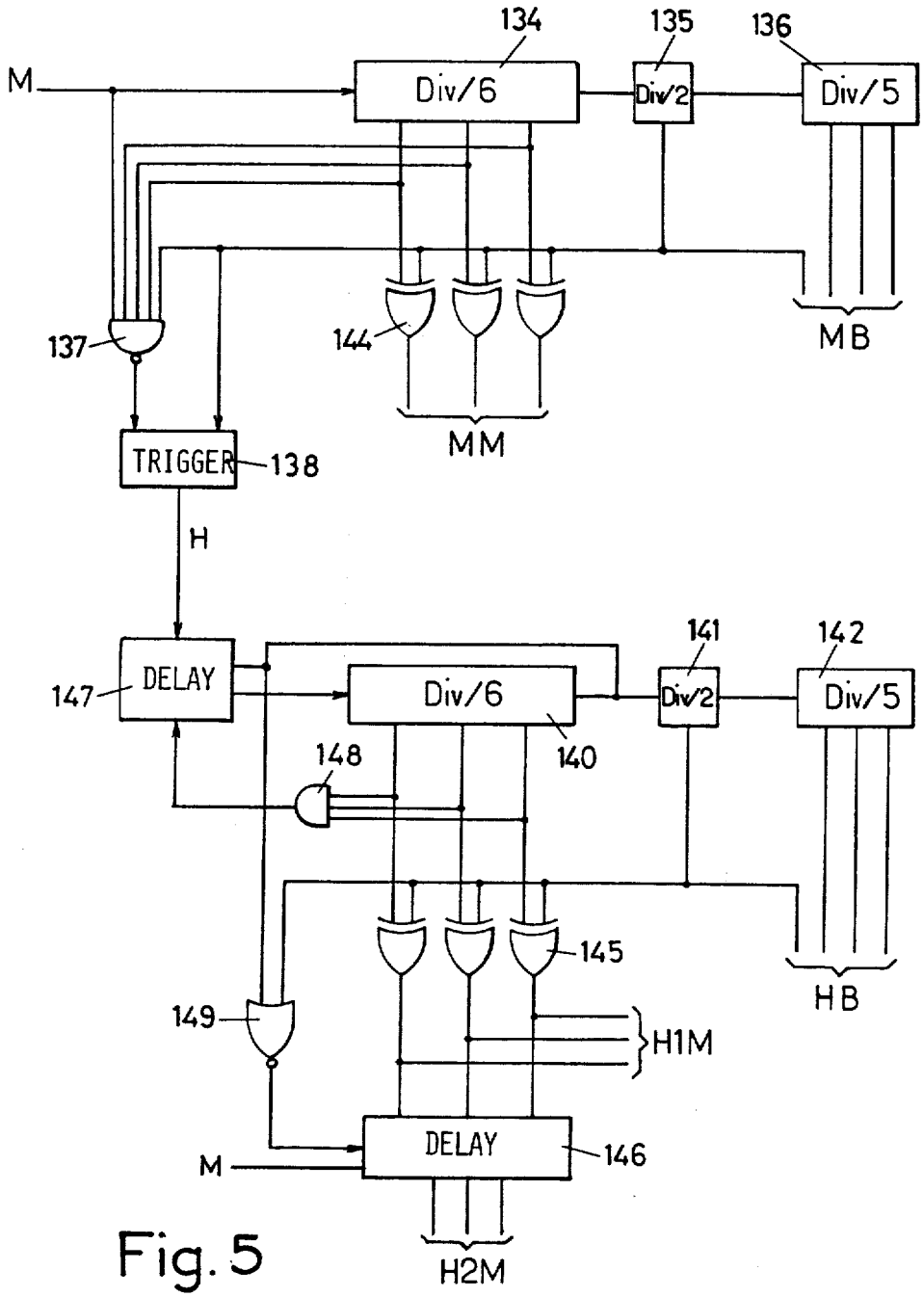
FIGS. 5, 6 and 7 are block diagrams of the same circuits shown in a more detailed manner.
Figure 6:
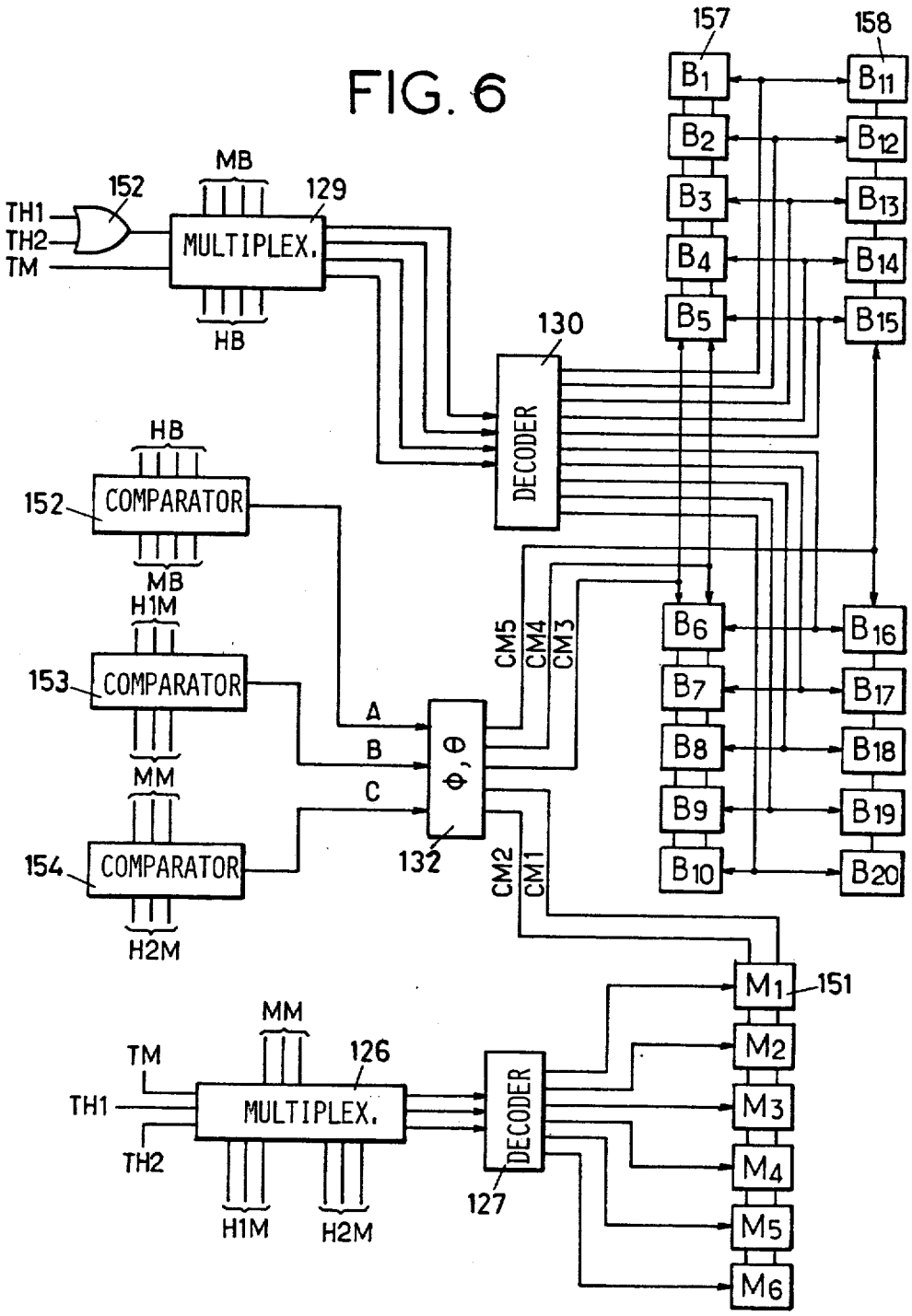
Figure 7:
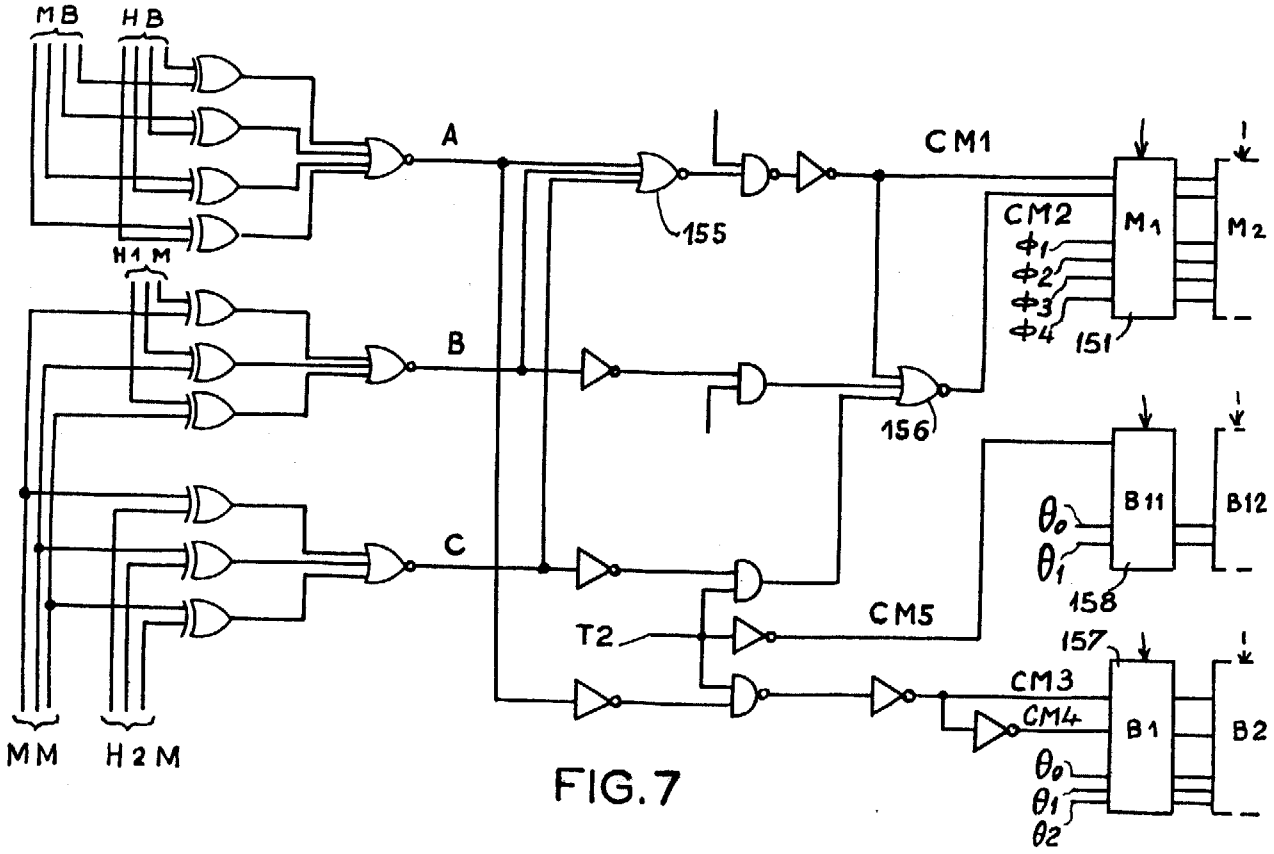

Part of the circuits of FIG. 4 are shown in greater detail in FIGS. 5 to 7.

The minute hand advance counter must divide by 60 the frequency of a signal M (FIG. 5) which consists of one pulse per minute. This counter comprises a divider 134 which divides by 6, a divider 135 which divides by 2, and a divider 136 which divides by 5. The data MB which define the annular sector (internal annular sector and external annular sector) of the minute hand from the ten possible positions in respect of that sector, are produced in binary form, on four lines, at the output from the dividers 135 and 136. A signal H which is formed by pulses emitted every 12 minutes is derived by a trigger circuit 138 from the divider dividing by 12, as formed by the dividers 134 and 135, passing the signals of the divider through an inverted AND gate 137 which causes displacement of those pulses by six minutes with respect to initialization of counting of the minutes, in the divider 134. The signal H is transmitted to the hour hand advance counter which, like the minute hand advance counter, comprises a divider 140 dividing by six, and a divider which divides by ten, comprising a divider 141 dividing by two and a divider 142 dividing by five. As in the case of the minute hand advance counter, the dividers 141 and 142 produce data HB in binary form on four lines, the data HB determining which of the ten angular sectors corresponds to the position of the hour hand, in its two arms.

The data relating to the position of the segments to be displayed on those sectors are produced from the dividers dividing by six, so as to define the appropriate meander circuits, from the six possible circuits. In regard to the minute hand, the signals from the three stages of the divider 134 are re-transmitted on the lines MM by way of three exclusive OR-gates 144 which also each receive the signal from the stage of the divider 135. The result of this arrangement is that, without altering the operation of the counters themselves, it is possible to reverse, in each group of six, the order in which the different meander circuits follow each other in the group, and thus to cause the meander circuits to follow each other in the order $M_1$ to $M_6$, then $M_6$ to $M_1$, then again $M_1$ to $M_6$, and so on. In fact, when it is at logic level 1, and only in that case, the signal of the divider dividing by two causes reversal of the logic level of each of the signals transmitted by the gates 144. The same arrangement is adopted for defining the position of the hour hand, in respect of the meander circuits, namely three exclusive OR-gates 145. In addition there is the distinction between the data in respect of selection of the position of the meander circuit required for displaying the first arm of the hour hand, that is to say, $H_1M$ and the data relating to the second arm of the same hand, that is to say $H_2M$. The second data are derived from the first in a digital delay circuit 146, by introducing a delay of one segment, that is to say, a delay of one pulse of the signal M.

The arrangement also includes a digital delay circuit 147, the function of which is to determine the moment at which the hour hand is at the end of an angular sector, this being in dependence on the data transmitted by an AND-gate 148 originating from the different stages of the divider 140, then to delay transmission to the counter of the signal H in order to preserve the hand position data unchanged until the following pulse arrives and is transmitted, to pass it directly to the counter on the one hand, and to the circuit 146 by way of a gate 149 on the other hand, in such a way as to resume normal counting at the beginning of the following sector.

FIG. 6 shows the multiplexers 126 and 129 of FIG. 4 and the associated decoders 127 and 130. The multiplexer 126 receives, in each case on three lines, the binary data defining the meander circuits, MM for the minute hand, $H_1M$ and $H_2M$ respectively for the two arms of the hour hand, and the corresponding synchronization signals TM, $TH_1$ and $TH_2$ which are required for multiplexing. The data received on three lines by the decoder 127 are re-transmitted on six lines respectively to each of the circuits 151 for controlling excitation of the meander circuits $M_1$, $M_2$ . . . $M_6$. In a similar manner, and in each case on four lines, the multiplexer 129 receives the binary data MB and HB, defining the annular sectors, for the minute hand and for the hour hand respectively, and the synchronization signals TM on the one hand for the minute hand, and on the other hand $TH_1$ and $TH_2$, which are mixed by a gate 162, for the hour hand. At the output from the decoder 130, the data transmitted by the multiplexer on four lines re-occurs on ten lines which pass the data respectively to the annular sectors of each pair $B_1$–$B_{11}$, $B_2$–$B_{12}$ . . . $B_{10}$–$B_{20}$. The distinction between long segments and short segments is not made at this level where the data involved is in respect of position selection. The distinction will be made at the level at which the waveforms are defined.

FIG. 6 shows the three comparators which make up the comparator 124 of FIG. 4. Comparison of the data in respect of position of the sectors HB (hour hand) and MB (minute hand) in a comparator 152 provides the signal A which shows if there is identity or difference; comparison of the data in respect of position of the segments likewise produces the signal B in a comparator 153 in respect of the first arm of the hour hand ($H_1M$), compared to the minute hand (MM), and the signal C for the second arm ($H_2M$) in a comparator 154.

In accordance with the conventional symbolism used in representing logic gates, FIG. 7 shows how these comparators may be formed, in one embodiment. FIG. 7 also shows how the circuit 132 of FIGS. 4 and 6 may be formed, this circuit deducing from the comparison signals A, B and C the waveforms selection control data. Taking into account the number of waveforms to be combined in each case, such data are re-translated into five signals $CM_1$, $CM_2$, $CM_3$, $CM_4$ and $CM_5$, essentially by means of two NOR-gates 155 and 156 and a reference voltage $T_2$. Two of these signals $CM_1$ and $CM_2$ are passed to the circuits 151 for controlling excitation of the meandering supply circuits $M_1$ . . . $M_6$, in order to effect therein the selection as between the waveforms Ø1, Ø2, Ø3 and Ø4, in accordance with the table set out hereinbefore, in those of the circuits which have also been selected in respect of position (by the individual signal from the decoder 127), it being appreciated that, in the absence of such a selection action, it is the waveform Ø4 which is applied. Likewise, the signals $CM_3$ and $CM_4$ are transmitted to the different circuits 157 for controlling excitation of the internal annular sectors $B_1$ to $B_{10}$, where they control transmission of the appropriate waveforms θ0, θ1 or θ2. They select θ1 or θ2 in the circuits of the sectors which are selected in respect of position (in accordance with the foregoing table) and θ0 in the others. For the circuits 158 corresponding to the external annular sectors, it is sufficient to have one signal, such as in this case $CM_5$, in order to control excitation by the waveforms θ1 in the single external sector which has been selected in respect of position (for the minute hand), the reference waveform θ0 being applied when that selection is not made.

The different circuits 151, 157 and 158 are formed from conventional flip-flops and logic gates, like the other electronic circuits of the device, in a manner which will be readily understood by the man skilled in the art, once the functions to be performed have been defined, as described above. In addition, the design of the different circuits may be the subject of many variations relative to the foregoing description, while producing the same functions.

Other modifications of the present invention will be apparent to those skilled in the art and it therefore is intended that various modifications of the disclosed preferred embodiment may be made within the principles of the invention and the scope of the appended claims.

What is claimed is:

1. An electro-optical analog time display device for displaying an hour hand on a 12 hour dial comprising a layer of electro-optical material having on one face a ring of ten sectorial plate electrodes each subtending an angle of 36° and on the other face 10 N radial segments electrodes, where N is an integer greater than 1, 10 groups of N segments being opposed to the 10 plates respectively and the segments being so connected in N meandering circuits M1 to MN that, in proceeding one way round the dial, the segments of the said groups pertain to the circuits M1 to MN and then the circuits MN to M1 and so on in alternation round the dial, the plate electrodes being asymetrical relative to the 12 o'clock axis of the dial so that a boundary between two adjacent plates is angularly offset from the said axis by a whole number of the segments.

2. A device according to claim 1 wherein the said whole number is 1 or 2.

3. A device according to claim 1 wherein the said whole number is 1.

4. A device according to claim 1, 2 or 3 wherein N is 6.

5. A device according to claim 1 wherein there are two concentric rings of the plate electrodes, an internal ring and an external ring, and comprising electronic circuits including time counters for controlling the electrodes in dependence on the state of the time counters which are so connected as to simulate a minute hand by a segment displaced on the plate electrodes of the two rings of the corresponding angular sector, passing from segment to segment to make one turn around the dial per hour, and an hour hand by means of two contiguous segments which are displayed on the internal ring only, which make a turn around the dial in 12 hours, and so as to control the display of the minute hand at 00 minutes on a segment adjoining the axis marking 12 o'clock in synchronization with the hour hand display which is centered on the said axis.

6. A device according to claim 5 wherein the progression of the hour hand is controlled at a rate of 12 minutes segment by segment, with a displacement in time of 6 minutes with respect to the movement of the minute hand to 00 min.

7. A device according to claim 5 or 6 wherein the electronic circuits are so connected as to control a simultaneous jump in respect to two segments of the hour hand from one sector to the other at each boundary between two sectors, and, over the remainder of the dial, a regular progression of the hand segment by segment, with a double stay on one side or the other of each boundary between two sectors.

8. A device according to claim 7 wherein the electronic circuits comprise means for determining the positions of the minute hand and each of the arms of the hour hand, in dependence on the state of the time counters, and selecting the corresponding meandering circuits and the radially internal and external plates of the corresponding angular sectors, comparison means for defining respectively by three control signals if the sector of the minute hand and that of the hour hand are identical, if the meandering circuit of the first arm of the hour hand and that of the minute hand are identical, and if the meandering circuit of the second arm of the hour hand and that of the minute hand are identical, and means which are controlled by the comparison signals for selecting corresponding waveforms to be applied to the meandering circuits, to the internal sectorial plates, and to the external sectorial plates, and to apply them to the selected meandering circuits and plates.

9. A device according to claim 8 wherein the selection of the waveforms is effected from four waveforms having three plateaux which are phase-shifted through 90° relative to each other, for the meandering circuits, two square waveforms and a reference signal for the internal sectors, and a square waveform and a reference signal for the external sectors.

10. A device according to claim 5 or 6 wherein selection of the meandering circuits is effected under the control of signals which translate in binary code the position data supplied at each counting cycle of the circuits, with reversal of the logic level of the signals in the course of one cycle in two.

* * * * *